US007334530B1

(12) United States Patent
Ruff

(10) Patent No.: US 7,334,530 B1
(45) **Date of Patent: *Feb. 26, 2008**

(54) SELF ALIGNING TABLE STORAGE SYSTEM

(75) Inventor: Edward J. Ruff, Naples, FL (US)

(73) Assignee: Edward J. Ruff Development, Inc., Naples, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/652,323

(22) Filed: Jan. 11, 2007

Related U.S. Application Data

(63) Continuation of application No. 10/874,497, filed on Jun. 23, 2004, now Pat. No. 7,168,371.

(51) Int. Cl.
*A47B 7/02* (2006.01)

(52) U.S. Cl. ..... 108/91; 312/247

(58) Field of Classification Search ..... 312/245, 312/246, 247, 319.5, 319.7; 108/20, 90, 108/147, 149, 91; 52/64, 66, 72, 506.01, 52/506.06–506.1; 248/327, 328, 329, 332
See application file for complete search history.

(56) References Cited

U.S. PATENT DOCUMENTS

| | | | | |
|---|---|---|---|---|
| 642,962 | A | 2/1900 | Danner | |
| 931,962 | A | 8/1909 | Roundtree | |
| 1,439,453 | A | 12/1922 | Streich | |
| 1,819,516 | A | 8/1931 | Kelly | |
| 2,656,231 | A | 10/1953 | Mahr | |
| 2,844,428 | A | 7/1958 | Puntenney | |
| 2,889,442 | A | 6/1959 | Schultz | |
| 3,048,459 | A | 8/1962 | Moore | |
| 3,743,287 | A | 7/1973 | Liermann | |
| 4,000,841 | A | 1/1977 | Bachli | |
| 4,345,758 | A | 8/1982 | Kempf | |
| 4,412,601 | A | 11/1983 | Cooper | |
| 4,756,119 | A | 7/1988 | Chabot | |
| 4,837,877 | A | 6/1989 | Hamada et al. | |
| 5,203,619 | A | 4/1993 | Welsch et al. | |
| 5,366,203 | A | 11/1994 | Huffman | |
| 5,871,070 | A | 2/1999 | Contreras | |
| 5,943,714 | A | 8/1999 | Dignam | |
| 6,131,702 | A | 10/2000 | Berridge | |
| 6,161,702 | A | 12/2000 | Campbell | |
| 6,250,728 | B1 | 6/2001 | Thorp | |
| D470,353 | S | 2/2003 | Mikich et al. | |
| D488,653 | S | 4/2004 | Ruff | |
| 6,851,376 | B2 | 2/2005 | D'Agostino | |
| 7,168,371 | B1 * | 1/2007 | Ruff | 108/20 |
| 2006/0084515 | A1 | 4/2006 | Berliner et al. | |

* cited by examiner

*Primary Examiner*—Janet M. Wilkens
(74) *Attorney, Agent, or Firm*—Pearne & Gordon LLP

(57) ABSTRACT

A stacking table system includes: a first table having a first top, first peripheral support rails extending downwardly from the first top and a plurality of alignment projections extending downwardly from the first peripheral support rails; a second table having a second top, second peripheral support rails extending downwardly from the second top and a plurality of alignment projection receptacles that receive respective alignment projections when the first table is in a stacked position on the second table; and a table hoist having a plurality of cables being selectively attachable to the tables. The first table may be hoisted upwardly by the hoist when the cables are attached to the first table and a stack of the first and second tables may be hoisted upwardly by the hoist when the cables are attached to the second table.

8 Claims, 7 Drawing Sheets

SELF ALIGNING TABLE STORAGE SYSTEM

This application is a continuation application of U.S. Utility patent application Ser. No. 10/874,497, filed Jun. 23, 2004, now U.S. Pat. No. 7,168,371, issued Jan. 30, 2007.

BACKGROUND OF THE INVENTION

The present invention relates to a system for the stacking storage of tables and, in particular, to self aligning tables for such a system.

Homeowners and others are often faced with the dilemma of trying to find room for multiple tables to conduct varied activities. These table might be, for example, billiard, table tennis, model train, slot car, and craft project tables. Often there is simply not enough floor space to accommodate all of the desired tables whether, for example, located in a garage, basement or recreation room.

The typical solution has been to use folding or removable legs and to store the tables on edge against a wall or in some closet-like structure.

Unfortunately, many times the items and/or structures on the tables are not suitable for being stored in such a manner. This necessitates either removing or otherwise securing the items and/or structures.

SUMMARY OF THE INVENTION

A stacking table system includes: a first table having a first top, first peripheral support rails extending downwardly from the first top and a plurality of alignment projections extending downwardly from the first peripheral support rails; a second table having a second top, second peripheral support rails extending downwardly from the second top and a plurality of alignment projection receptacles that receive respective alignment projections when the first table is in a stacked position on the second table; and a table hoist having a plurality of cables being selectively attachable to the tables. The first table may be hoisted upwardly by the hoist when the cables are attached to the first table and a stack of the first and second tables may be hoisted upwardly by the hoist when the cables are attached to the second table.

DESCRIPTION OF THE PREFERRED EMBODIMENTS

Figure 1:
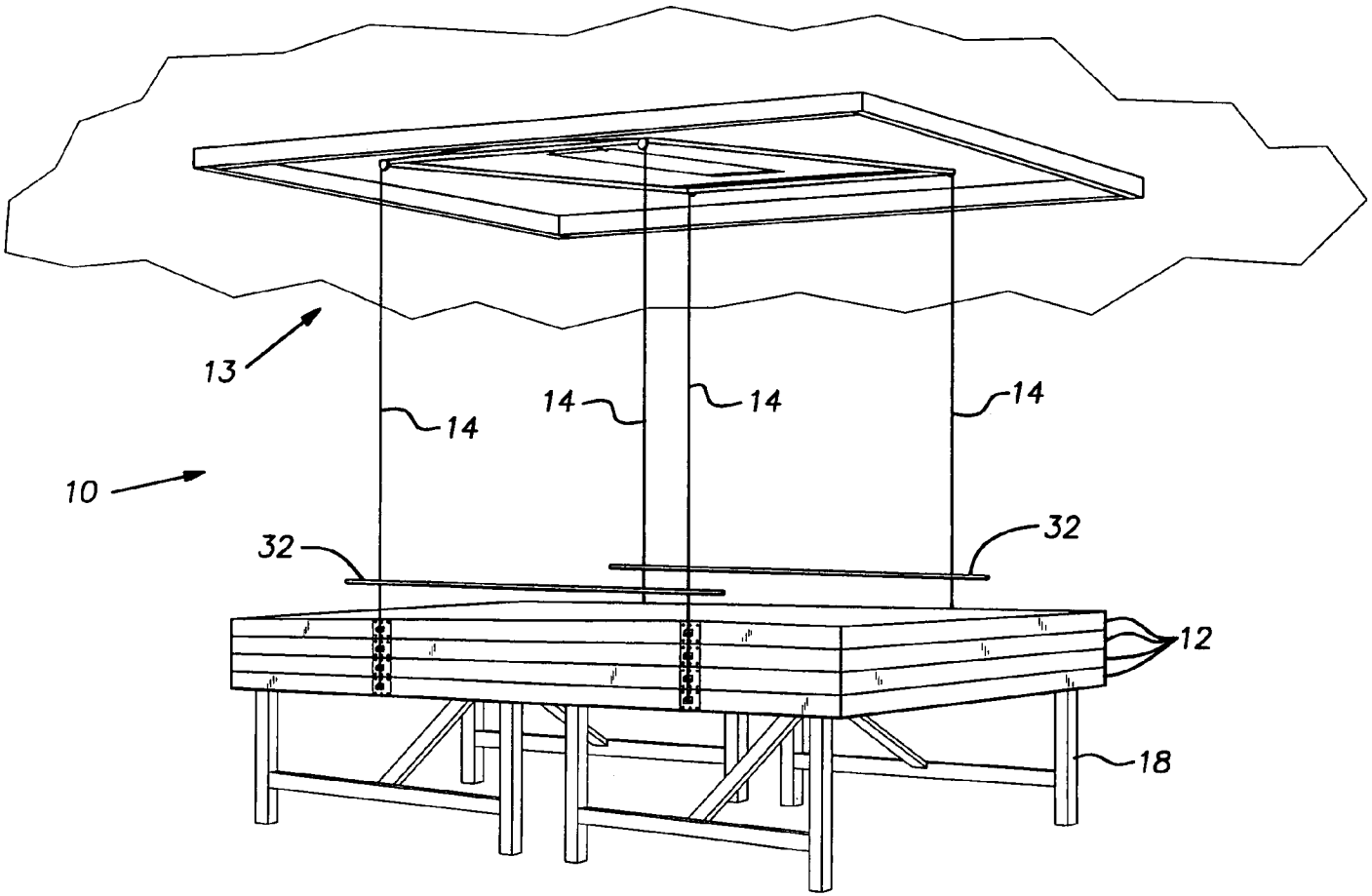
FIG. 1 is a perspective view of a stacking table system according to the invention.

Referring to FIG. 1, a stacking table system 10 includes a stack of tables 12, a table hoist 13 including hoisting cables 14 and a ceiling mechanism 16 described more fully below. The table 12 may have, for example, folding legs 18.

Figure 2:
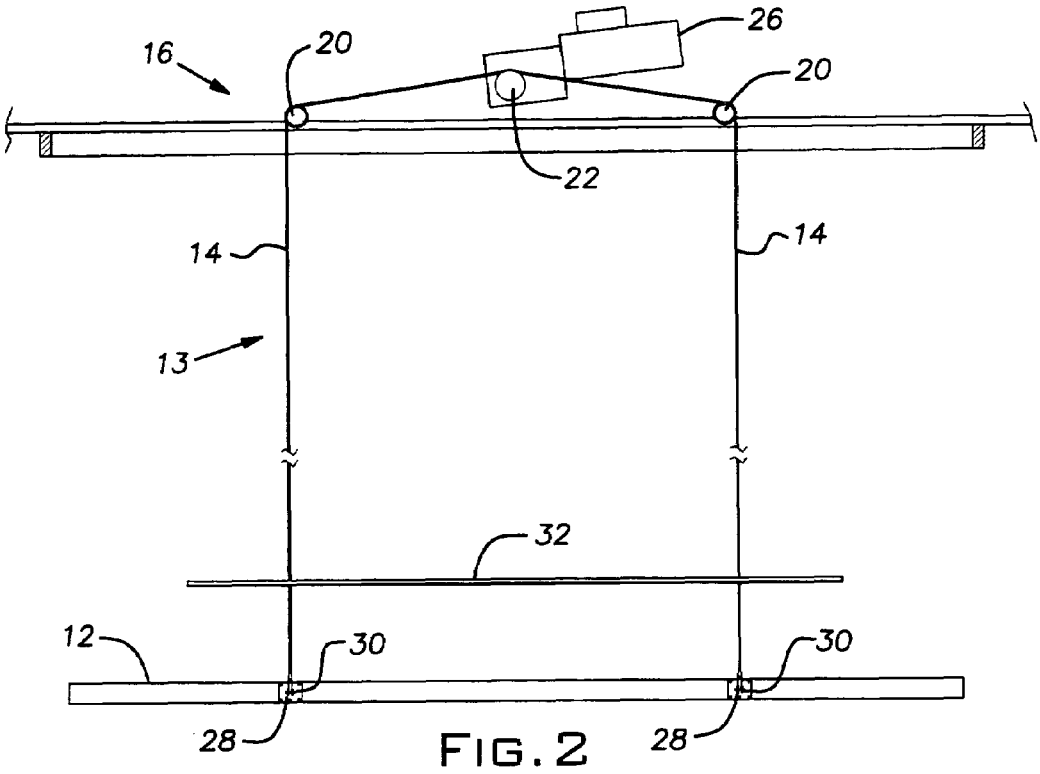
FIG. 2 is a front elevation view of a system according to the invention with a single table being hoisted.
Figure 3:
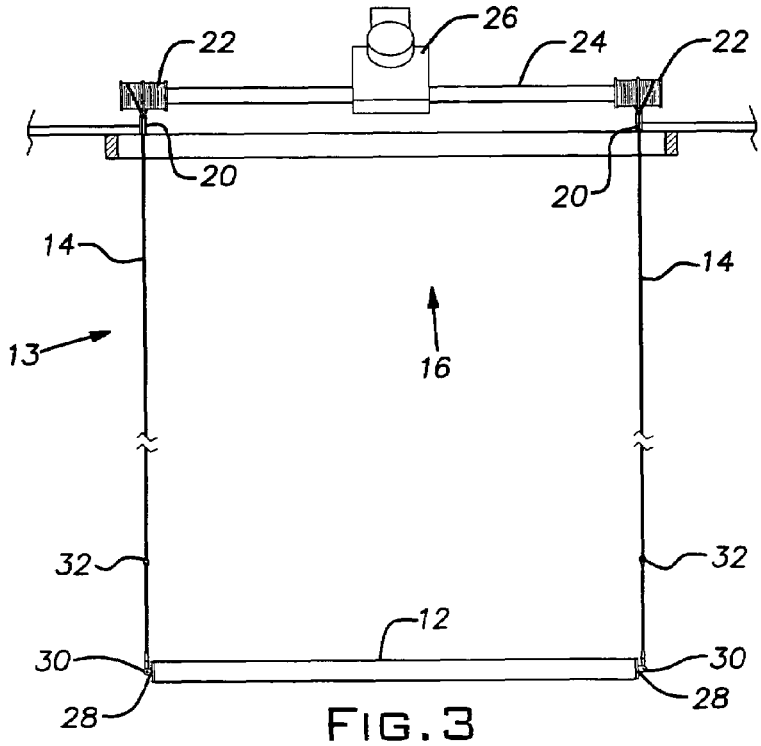
FIG. 3 is a side elevation view of a system according to the invention with a single table being hoisted.
Figure 7:
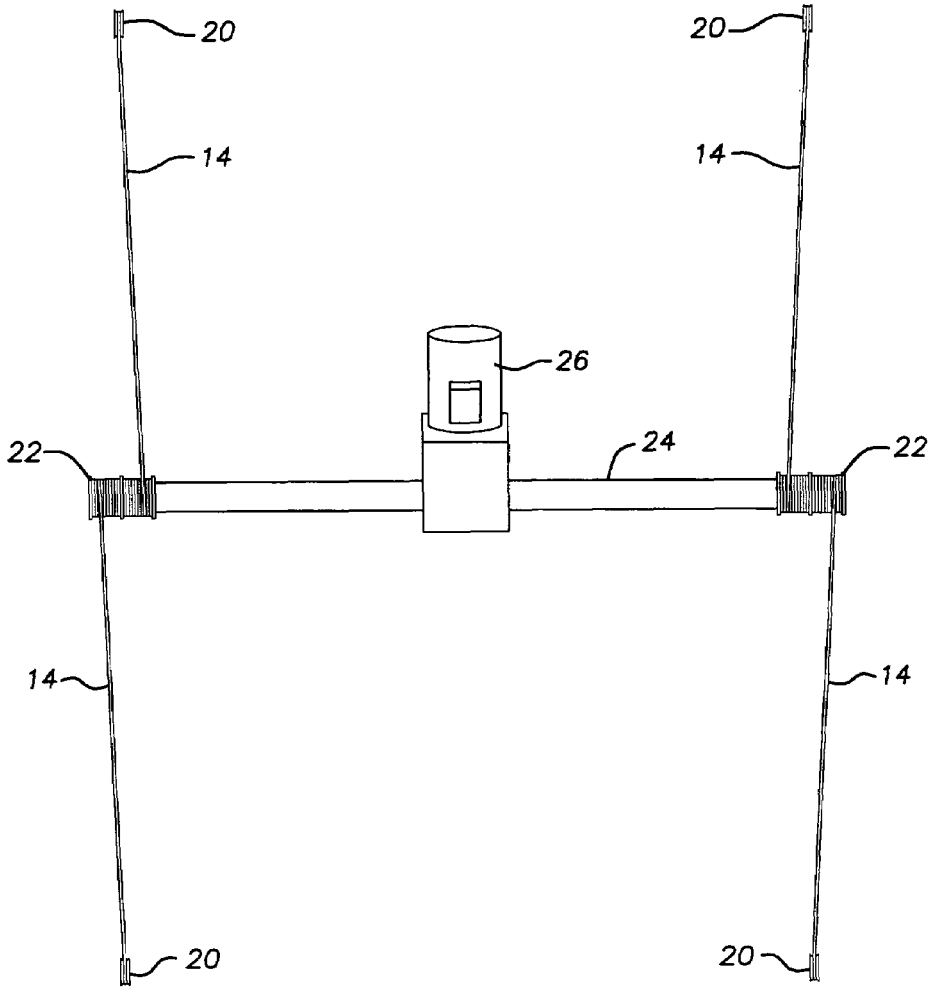
FIG. 7 is a top plan view of a hoisting mechanism for a system according to the invention.

Referring to FIGS. 2, 3 and 7, the ceiling mechanism 16 includes pulleys 20, spools 22, a shaft 24 and a motor 26. The cables 14 pass over the pulleys 20 and are wound onto the spools 22 on the shaft 24 driven by the motor 26. The cables 14 may be provided with unshown eyes at their free ends. The free ends may then be removably attached to a table 12 using clevises 28 and clevis pins 30 attached to the sides of the table 12. One or more pairs of the cables 14 may be provided with a spacer bar 32. The bar 32 advantageously assists in aligning the cables 14 with the devises 30 and in maintaining useful tension on the cables 14. The spacer bar 32 may also be used to cooperate with unshown limit switches to control the maximum elevation of the tables 12.

Other embodiments of the ceiling mechanism are of course possible. For example, separate motors and shafts may be used for each cable.

In operation, a stack of the tables 12 may be stored in proximity to the ceiling mechanism 16 by attaching the cables 14 to the bottom-most of the tables 12 and hoisting the tables 12 with the table hoist 13 until the stack of tables 12 is located a desired level above a floor under the tables.

The bottom-most of the tables 12 may be removed from the stack of tables 12 by lowering the stack of tables 12 to the floor beneath the tables 12, attaching the cables 14 to the next higher of the tables 12 and hoisting the shorter stack of tables 12 with the table hoist 13 clear of the bottom-most of the tables 12 which becomes an independent table 12.

The table 12 at the bottom may have, for example, folding legs, removable legs or other suitable free standing supports. The supports may also include, for example, wheels or other aids to movement.

To provide access to the next lowest of the tables 12, the independent table 12 is moved from under the stack of tables 12 and the above process repeated. The independent table 12 may be, for example, manually carried, rolled or slid by the user to its new position.

It can be readily appreciated that the above-described operations can be used to provide usable access to any of the tables 12. For example, quick access to the top-most table may be provided by lifting off just the top-most of the tables 12, moving the lower tables out of the way, lowering the top-most table to the floor, moving the top-most table out of the way and hoisting what were the lower tables upward again. It is of course possible for multiple tables to be arranged for use about the floor with the remaining, if any, tables hoisted to the ceiling mechanism.

Figure 4:
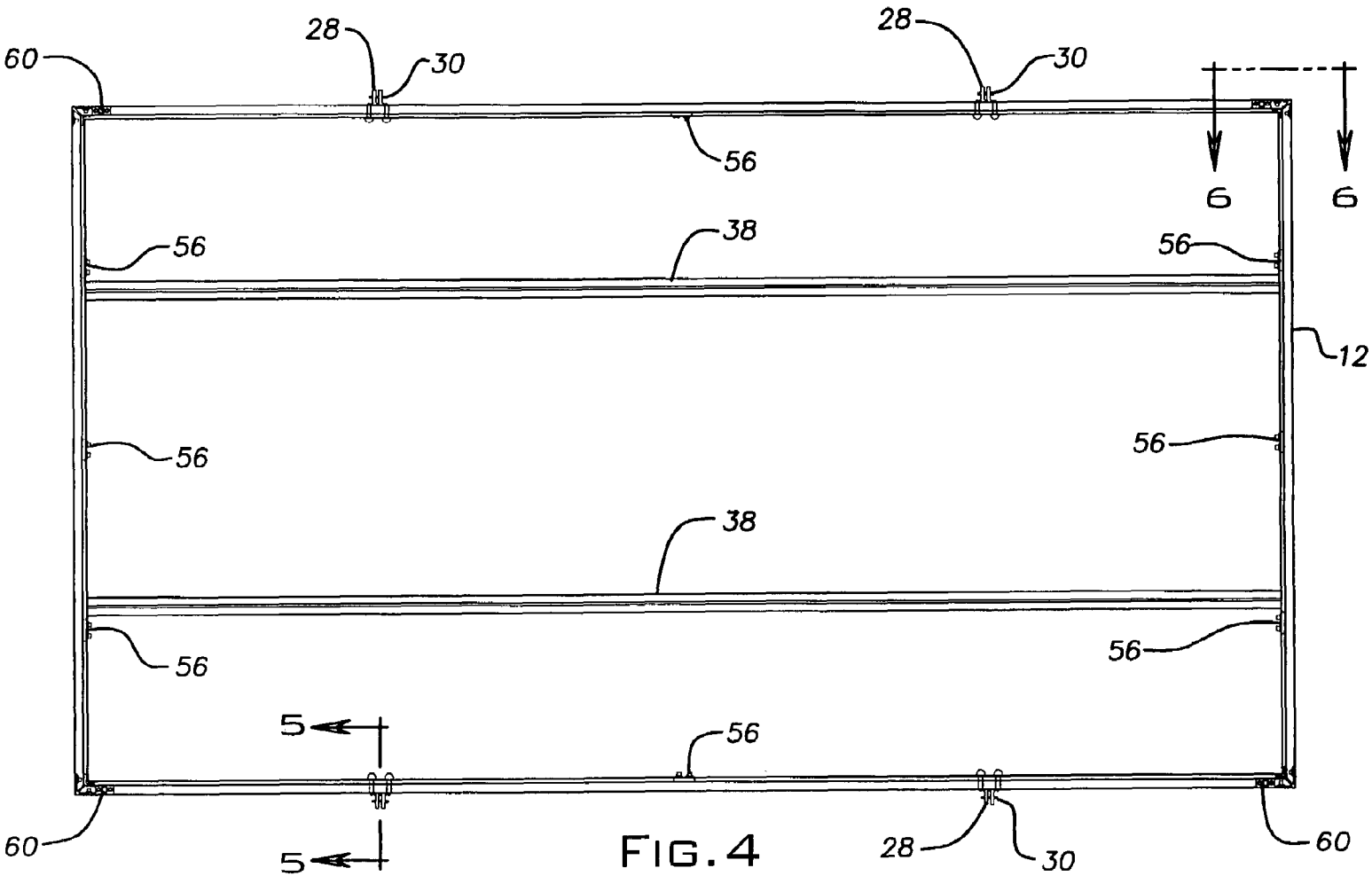
FIG. 4 is a bottom plan view of a table according to the invention.

Referring to FIG. 4, a table 12 includes a table top 34 with peripheral support rails 36. The table top may also, for example, include stiffening structures 38 such as ribs or slats.

Figure 5:
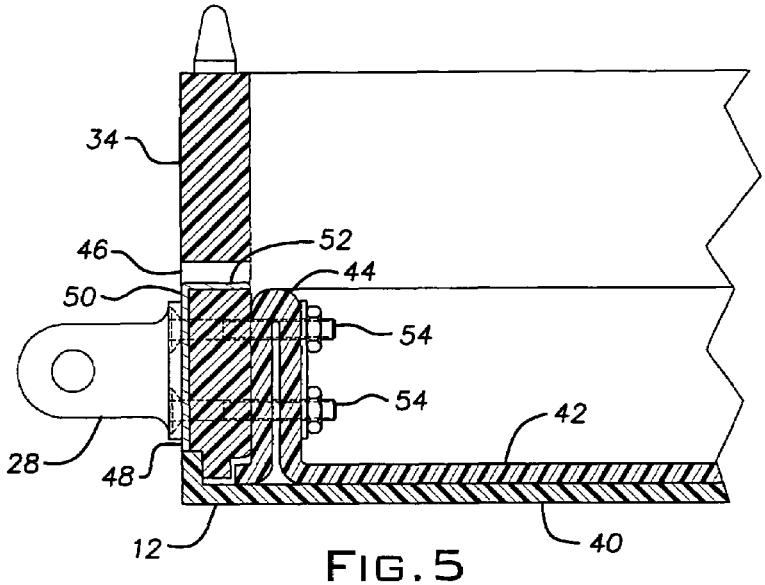
FIG. 5 is a cross sectional view along the line 5-5 of FIG. 4.

Referring to FIG. 5, a possible construction of the table 12 includes a top layer 40 and a sub-layer 42 having a lip 44. The rail 34 is provided with a slotted aperture 46 having a length approximately equal to the width of the clevis 28. The vertical leg 48 of a L-shaped bracket 50 is located between the clevis 28 and the rail 34. The horizontal leg 52 of the bracket 50 is received in the aperture 46. Fasteners 54 pass through apertures in the clevis 34, the vertical leg 48 and the lip 44 to fasten the pieces together. The fasteners 54 may be, for example, nuts and bolts.

A similar arrangement, but without a clevis 34, can be employed at the locations 56 (FIG. 4). Cooperation between the apertures 46 and the brackets 50 increase the integrity of the table structure.

The top layer 40 may be fastened to the sub-layer 42 by suitable means such as nuts and bolts, screws, nails or adhesives.

The sub-layer 42 may be advantageously formed from several planar sections, each having peripheral lips that together form the stiffening structures 38. The sections may be, for example, formed of blow molded or injection molded plastic.

Figure 6:
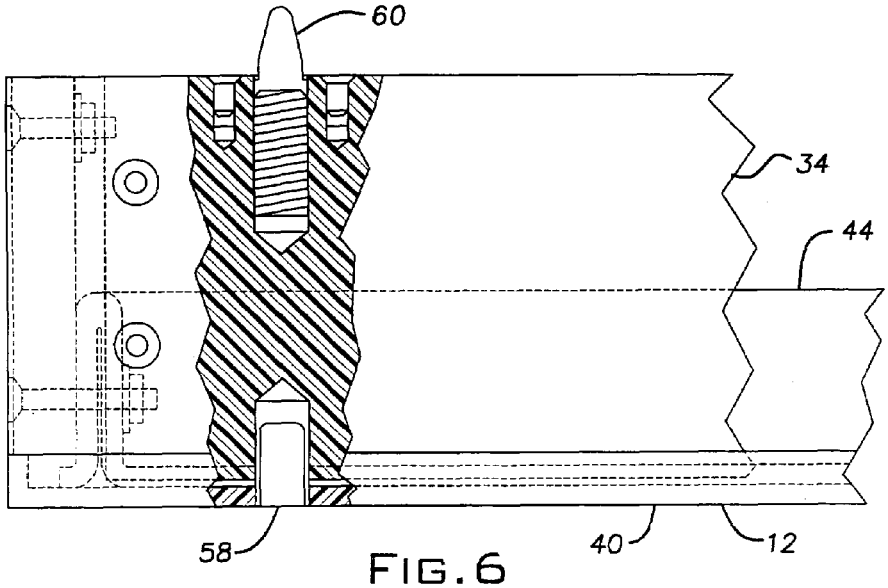
FIG. 6 is a cross sectional view along the line 6-6 of FIG. 4.

Referring to FIG. 6, the tables 12 include alignment receptacles 58 and alignment projections 60. The projections 60 may be, for example, spring loaded pins mounted in the lower edge of the rails 34. The receptacles 58 are located on the top of the table 12. The receptacles 58 and projections 60 of respective tables 12 in a stack are arranged to be in engagement when the tables of the stack are aligned one directly above the other. This aids in both obtaining and maintaining alignment of the stack.

Figure 8:
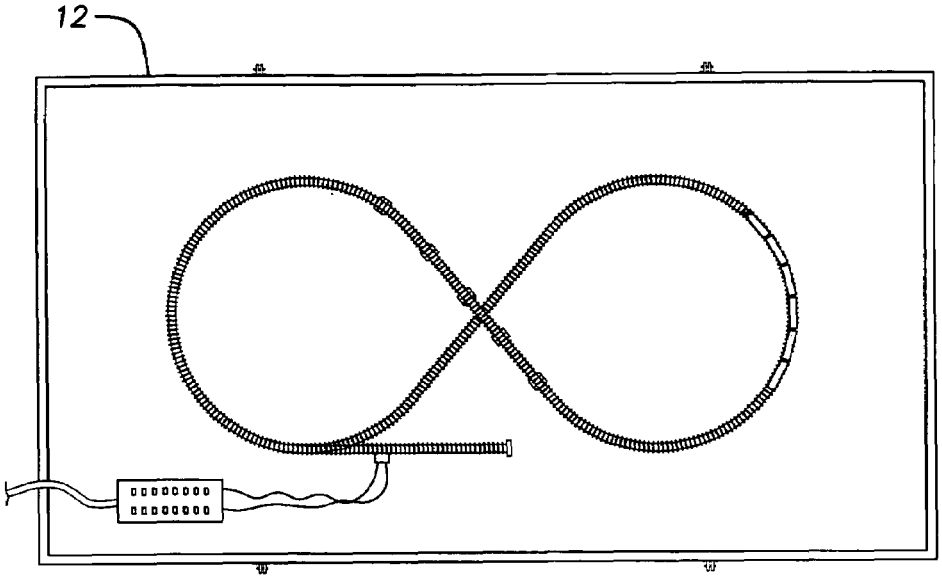
FIG. 8 is a top plan view of a table for a model train layout.

Referring to FIG. 8, a table 12 may be part of a model train layout.

Figure 9:
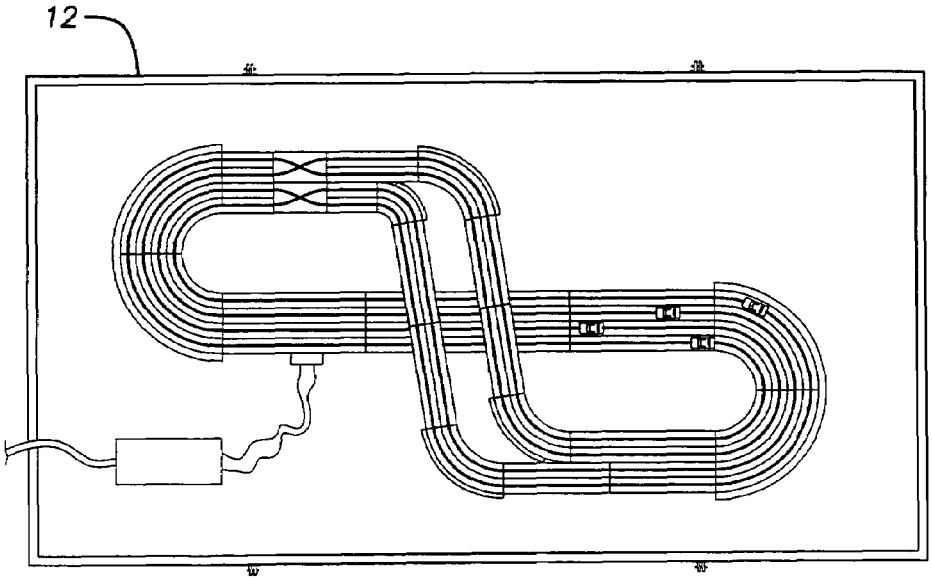
FIG. 9 is a top plan view of a table for a slot car track.

Referring to FIG. 9, a table 12 may be part of a slot car layout.

Figure 10:
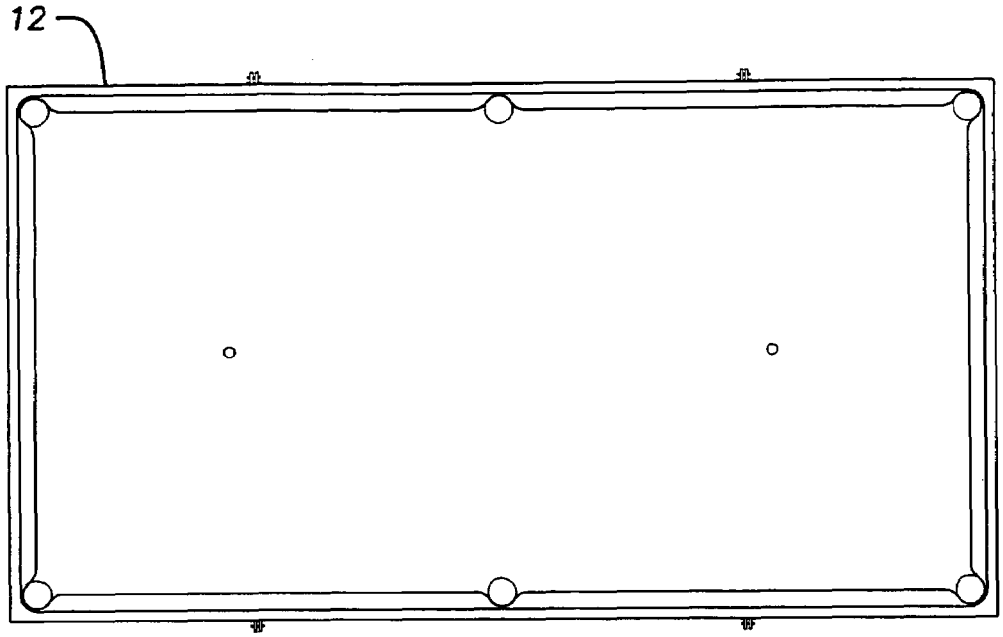
FIG. 10 is a top plan view of a table for a billiard table.

Referring to FIG. 10, a table 12 may be part of a billiard table.

Figure 11:
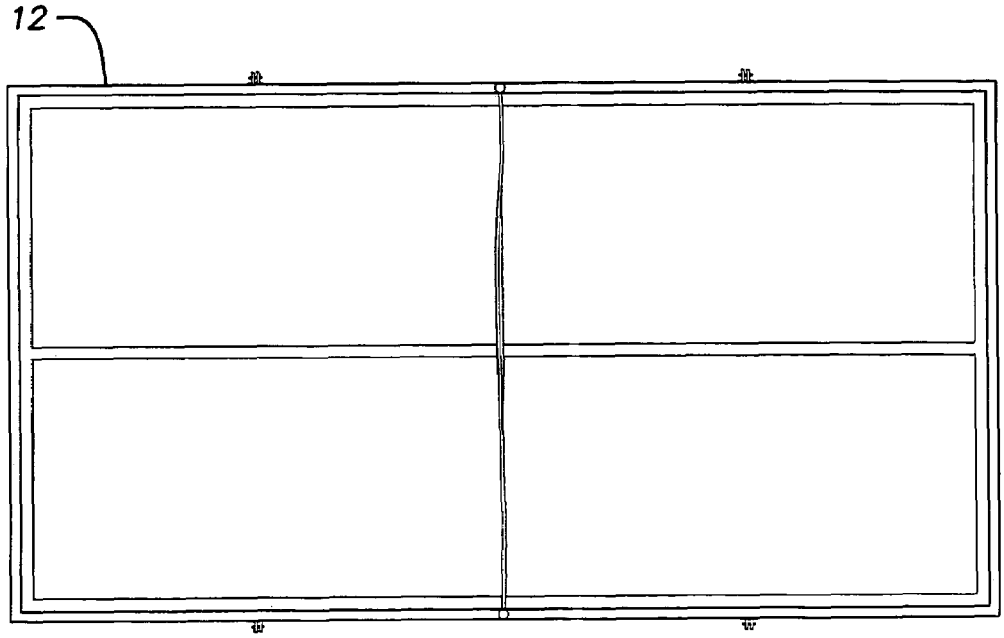
FIG. 11 is a top plan view of a table for a table tennis table.

Referring to FIG. 11, a table 12 may be part of a table tennis table.

In order to accommodate the various uses for the tables 12, the heights of the rails 34 may be varied according to the application. For example, a model train layout may have relatively tall structures. In order to allow the stacking of other tables on top of the train layout table without altering the train layout, rails 34 high enough to accommodate the train layout would be used on any table to be stacked immediately above the train layout.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A stacking table system, said system comprising:

a first table, said first table having a first top, first peripheral support rails extending downwardly from said first top;

a second table, said second table having a second top, second peripheral support rails extending downwardly from said second top, wherein said first rails have a height chosen to accommodate a structure located on said second table; and a table hoist having a plurality of cables being selectively attachable to said tables, wherein said first table may be hoisted upwardly by said hoist when said cables are attached to said first table and a stack of said first and second tables may be hoisted upwardly by said hoist when said cables are attached to said second table.

2. A stacking table system according to claim 1, wherein at least one of said tables is a billiard table.

3. A stacking table system according to claim 1, wherein at least one of said tables is a table tennis table.

4. A stacking table system according to claim 1, wherein at least one of said tables includes a model train layout.

5. A stacking table system according to claim 1, wherein at least one of said tables includes a slot car racing layout.

6. A stacking table system according to claim 1, wherein at least one of said tables includes folding legs.

7. A stacking table system according to claim 1, wherein said table hoist winds said plurality of cables onto a single shaft.

8. A stacking table system, said system comprising:

a first table, said first table having a first top, first peripheral support rails extending downwardly from said first top;

a second table, said second table having a second top, second peripheral support rails extending downwardly from said second top; and a table hoist having a plurality of cables being selectively attachable to said tables, wherein said first table may be hoisted upwardly by said hoist when said cables are attached to said first table and a stack of said first and second tables may be hoisted upwardly by said hoist when said cables are attached to said second table; and a plurality of L-shaped brackets, said brackets having a horizontal leg and a vertical leg, said vertical leg having apertures, wherein said peripheral support rails have horizontal slots therein adapted to receive the horizontal leg of respective L-shaped brackets and said rails are fastened to said tops with fasteners passing through said apertures, said rails and said tops.

* * * * *